United States Patent [19]

Ishii

[11] Patent Number: 4,462,030

[45] Date of Patent: Jul. 24, 1984

[54] ELECTRONIC APPARATUS WITH AUDIBLE ANNUNCIATOR AND ALARM LAMP

[75] Inventor: Daisuke Ishii, Tokyo, Japan

[73] Assignee: Nippon Electric Co., Ltd., Tokyo, Japan

[21] Appl. No.: 329,387

[22] Filed: Dec. 10, 1981

[30] Foreign Application Priority Data

Dec. 16, 1980 [JP] Japan ..... 55-178340

[51] Int. Cl.[3] ..... G08B 5/22

[52] U.S. Cl. ..... 340/825.44; 340/327

[58] Field of Search ..... 340/311.1, 326, 327, 340/825.44, 825.48; 455/38, 35, 228

[56] References Cited

U.S. PATENT DOCUMENTS 3,742,481 6/1973 Nickerson ..... 340/825.48

4,194,153 3/1980 Masaki et al. ..... 340/825.44

4,249,165 2/1981 Mori ..... 340/825.44

*Primary Examiner*—James J. Groody

*Attorney, Agent, or Firm*—Laff, Whitesel, Conte & Saret

[57] ABSTRACT

A portable electronic apparatus has an oscillator for generating a signal. An audible annunciator has an inductance element for generating an audible annunciating signal in response to a first actuation signal of a first frequency. A light emitting means is turned on and off by counter-electromotive forces developed in the inductance element in response to one of the first actuation signal and a second actuation signal of a second frequency. A frequency divider is coupled to the audible annunciator and to the light emitting means for frequency-dividing the oscillation signal to provide the first and second actuation signals and for selectively generating one of these actuation signals in response to a control signal.

9 Claims, 11 Drawing Figures

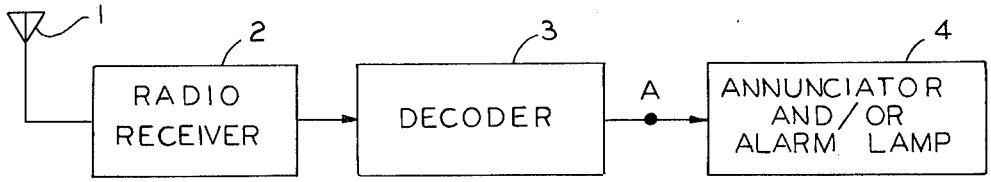
FIG.1
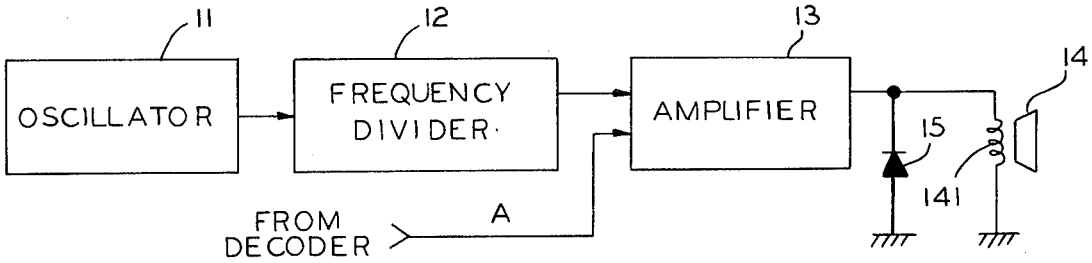
FIG. 2
(PRIOR ART)
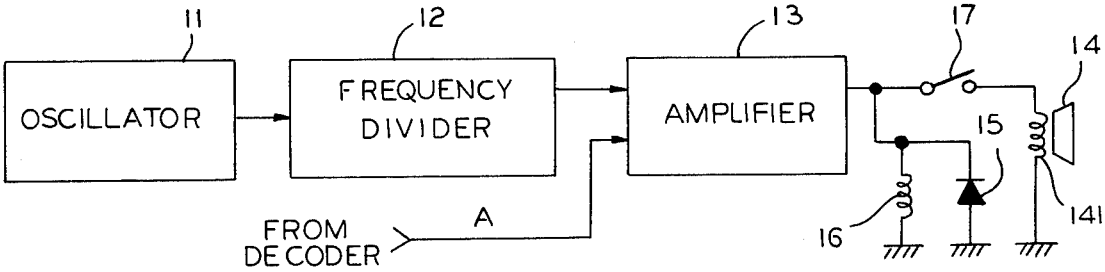
FIG.3
(PRIOR ART)
FIG.4
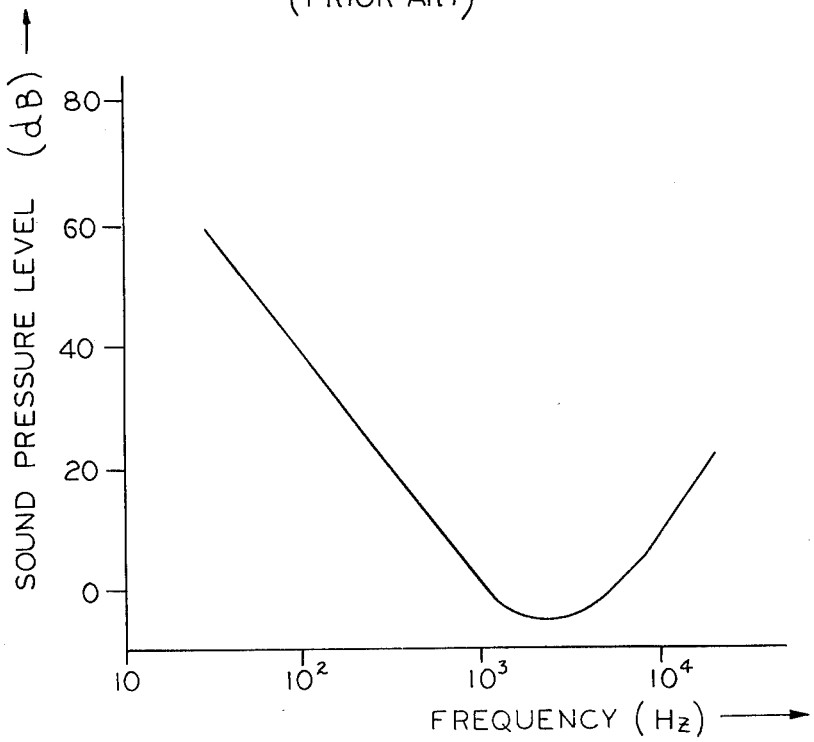

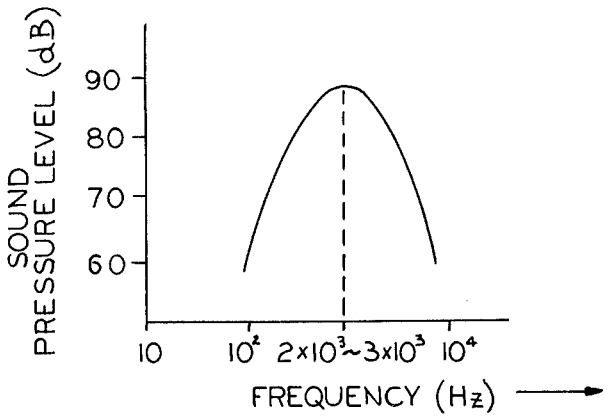
FIG.5
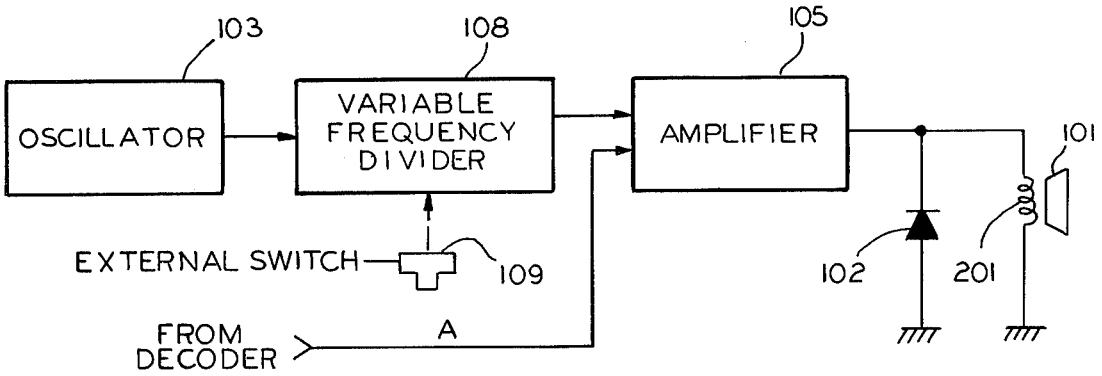
FIG.6
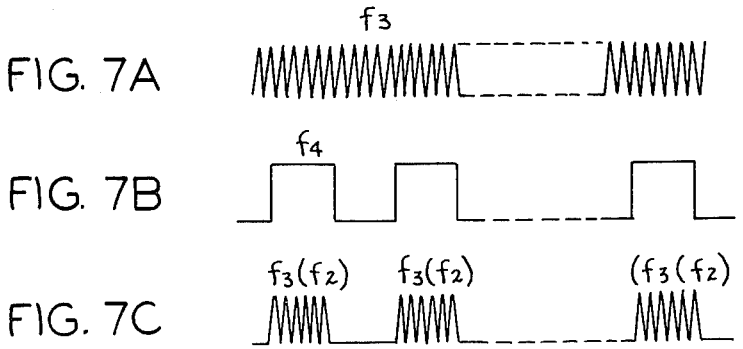
FIG. 7A
FIG. 7B
FIG. 7C

ELECTRONIC APPARATUS WITH AUDIBLE ANNUNCIATOR AND ALARM LAMP

BACKGROUND OF THE INVENTION

The present invention relates to a portable electronic apparatus, and more particularly to a portable electronic apparatus having an audible annunciator, such as a loudspeaker, and an alarm lamp.

A portable electronic apparatus, such as a pager receiver, having a function to alarm or to notify its bearer, is equipped with an audible annunciator, such as a loudspeaker, for alerting the bearer. In the case of a pager receiver, the sound of its loudspeaker informs its bearer that he is being paged. However, in those cases where a plurality of receivers are used at the same time or where a receiver has to be used in an environment having a high-level of noise, it may be difficult to distinguish the sounding receiver from other sounds. Also, the pagee may fail to notice the sound. As a solution to these problems, some paging receivers are equipped with an alarm lamp in addition to a loudspeaker. The loudspeaker and lamp are turned on simultaneously with the activation of the annunciator. An example of such a pager receiver is disclosed in U.S. Pat. Nos. 3,783,384 and Re. 28,222.

A light emitting diode (LED) is usually employed as the alarm lamp. The activation of this LED requires about 1.5 volts. However, because a radio pager receiver or the like is ordinarily powered by a single dry battery of 1.2 to 1.7 volts, to reduce its size, the dropping of the battery's voltage may disable the LED. To avoid this trouble, the inductance of the driving coil in the loudspeaker is used to generate counter-electromotive forces at both ends of the indictance element, these forces being utilized to turn on and off the LED.

On the other hand, if the receiver has to be used in a quite evnironment, it will be desirable to alert the bearer of the receiver merely by turning on the lamp without giving any sound. Unlike the above cited instance, the loudspeaker inductance elements cannot be used to add a counter-electromotive force during this function. Another inductance element will have to be provided exclusively for the lamp and arranged to be switched on and off, as required. However, the additional inductance element is not advisable for a portable electronic apparatus which is small and light.

SUMMARY OF THE INVENTION

One object of the present invention, therefore, is to provide a portable electronic apparatus which is able to alert its bearer with its lamp alone and yet is small and light.

According to the invention, a portable electronic apparatus has an oscillator means for generating an oscillation signal. An audible annunciator means has an inductance element for generating an audible annunciating signal in response to a first actuation signal of a first frequency. A light emitting means is turned on and off counter-electromotive forces developed in the inductance element in response to one of the first actuation signal and a second actuation signal of a second frequency. A frequency divider means is coupled to the audible annunciator means and to the light emitting means for frequency-dividing the oscillation signal to provide the first and second actuation signals and for selectively generating one of these actuation signals in response to a control signal. A gate means is connected to the frequency divider means, the audible annunciator means and the light emitting means, for supplying the audible annunciator means and the light emitting means with one of the first and second actuation signals in response to an alert signal. An external switching means supplies the first control signal to the frequency divider means.

BRIEF DESCRIPTION OF THE DRAWINGS

Other objects, features and advantages of the present invention will be made more apparent from the detailed description hereunder taken in conjunction with the accompanying drawings, wherein:

FIG. 1 is a block diagram of a pager receiver suitable for the application of a calling-alarm circuit, according to the present invention;

FIGS. 2 and 3 are block diagrams which schematically show conventional calling-alarm circuits;

FIG. 4 is a graph which shows a frequency characteristic of an audible signal;

FIG. 5 is another graph which shows the frequency characteristic diagram of an audible annunciator for use in a pager receiver;

FIG. 6 is a block diagram of an embodiment of the calling-alarm circuit according to the present invention;

FIGS. 7A through 7C show time charts for explaining the circuit of FIG. 6;

DESCRIPTION OF THE PREFERRED EMBODIMENT

Figures 8, 9:
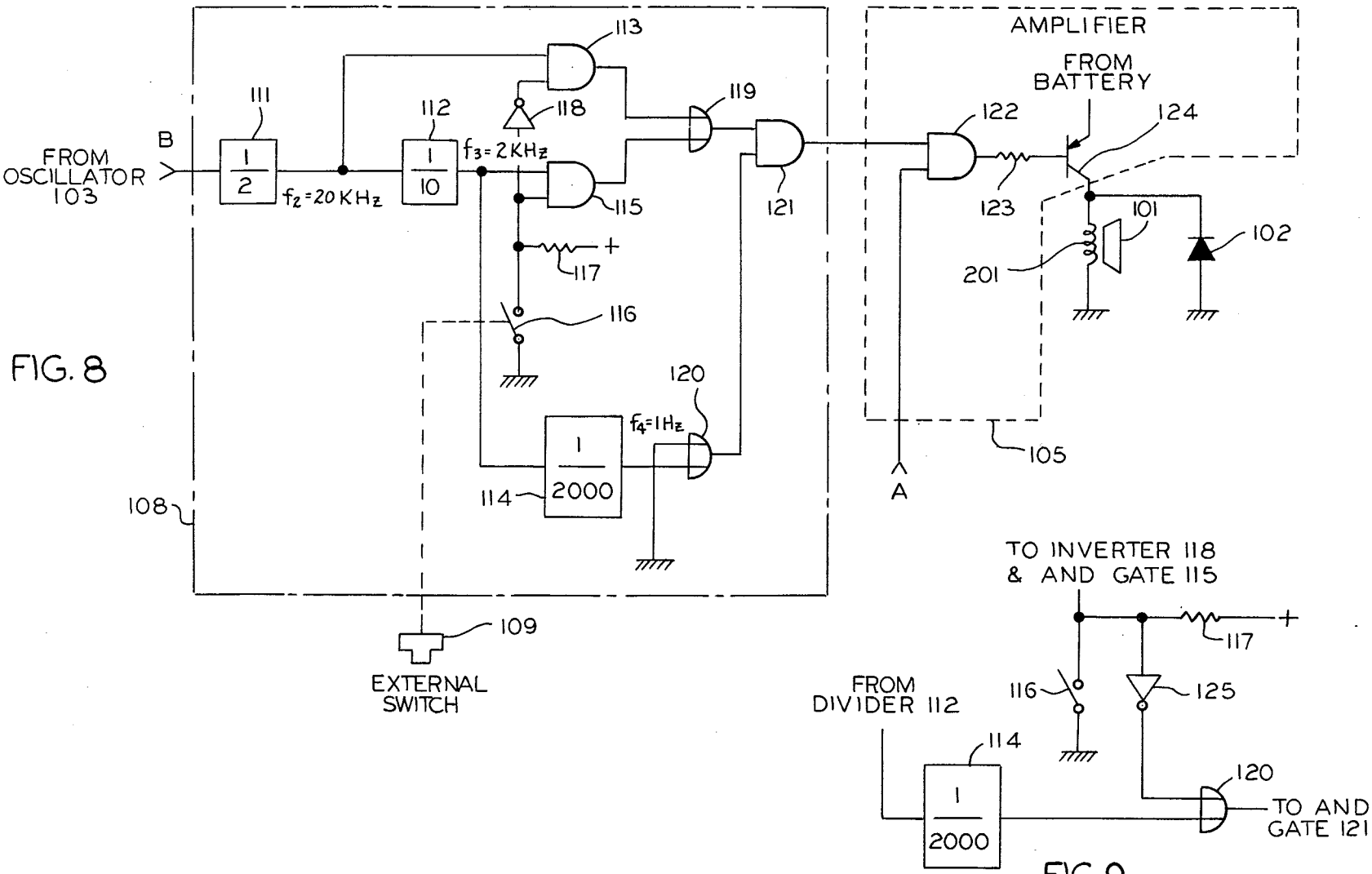
FIG. 8 is a block diagram of an embodiment of the variable frequency-divider circuit of FIG. 6.
FIG. 9 is a partial block diagram of a modification of the circuit illustrated in FIG. 8.

FIG. 1 shows a system for responding to a paging signal of a radio frequency picked up by an antenna 1 and demodulated by a radio receiver circuit 2 into a baseband signal. Then, it is supplied to a decoder circuit 3, which checks the demodulated baseband calling signal to determine whether or not it is identical with the identification number of the receiver and, if it is, to give an alert signal A as its output. In response to the alert signal A, an annunicator 4 notifies the bearer of the receiver that he is being paged. The notification may be by sounding a loudspeaker and/or lighting an alarm lamp. For the details and functioning of the circuitry up to the point where the alert signal A is provided, reference is made to the U.S. Pat. No. 4,127,846 granted to Mori, et al. or the U.S. Pat. No. 4,194,153 granted to Masaki, et al., both assigned to the assignee of the present application.

FIG. 2 shows one example of a circuit for simultaneously giving an audible signal and for lighting an alarm lamp. An oscillation signal of a relatively high frequency (about 30~40 kHz) from an oscillator 11 is frequency-divided by a frequency divider 12, to provide an audible frequency. The divided signal is fed to an amplifier 13, to which also is supplied the alert signal A from the decoder section (FIG. 1). Only when this alert signal is given to it, the amplifier 13 amplifies the frequency-divided signal received from divider 12 in order to activate a loudspeaker 14. At the same time, with the sounding of the loudspeaker 14, a counter-electromotive force is generated in the inductance element 141 of the speaker 14, which force turns a light emitting diode (LED) 15 on and off. This circuit, which always operates the loudspeaker 14 and the LED 15 simultaneously, is inconvenient when the bearer of the receiver wants to be notified of a call only by the lighting of the LED 15, i.e., when the call has to be by a silent signal, as when the bearer is in a hospital or attending a conference.

An approach to overcome this inconvenience is embodied in the circuit illustrated in FIG. 3. A switch 17 is closed when it is desired to activate the loudspeaker 14 and the LED 15 at the same time. Conversely, when the switch 17 is open, the LED 15 will be turned on and off by the counter-electromotive force of an inductance element 16 in response to an alert signal, but the loudspeaker 14 will not sound so that the desired effect can be achieved. However, this circuitry involves the disadvantage that it is bulky because of the inductance element 16 as stated above.

Before describing an embodiment of the present invention which does not have the disadvantages of the conventional circuits shown in FIGS. 2 and 3, it may be pertinent to explain the limits of audible frequencies and the frequency characteristic of a loudspeaker (audible annunciator) used in a pager receiver.

FIG. 4 shows the lowest sound pressure level of frequencies which man can recognize as sounds. The abscissas indicates frequency which is logarithmically graduated, and the ordinates indicates sound pressure levels. The audible frequencies range from 15–20 Hz at the lowest to 20,000 Hz at the highest, and the lowest audible sound pressure level significantly varies with frequency.

FIG. 5 charts the frequency characteristic of the audible annunciator used in a pager receiver. The abscissas, which indicates frequency, is logarithmically graduated, and the ordinates indicates the sound pressure level. Because a pager receiver is required to be small, an efficient but small audible annunciator is used therein. Since such a receiver needs sounds of no more than one frequency, an audible annunciator is used which resonates in the vicinity of a single frequency, thereby increasing its sound pressure. This single frequency is usually in the range of 2 kHz to 3 kHz, taking the characteristic of FIG. 4 and the power consumption of the receiver into consideration. Therefore, putting together the lowest audible sound pressure level shown in FIG. 4 and the frequency characteristic of the audible annunciator charted in FIG. 5 reveals that the frequencies of sounds generated by any audible annunciator, which can be heard by a human, are limited to a very narrow range.

FIG. 6 is a block diagram of a vital part of one embodiment of the present invention. An oscillator circuit 103 uses any one of a crystal resonator, a ceramic resonator, or a multivibrator. The output of the oscillator circuit 103 is led to a variable frequency divider 108, whose dividing number can be varied with the operation of an external switch 109. The output of the variable frequency divider 108 is applied to an amplifier circuit 105 and, after amplification, supplied to an LED 102 and a loudspeaker 101. The amplifier circuit 105, in supplying its output signal to the loudspeaker 101 and the LED 102, is controlled by an outside alert signal A, such as from a decoder of the pager receiver. The alert signal A actuates the amplifier circuit 105, indicating that the pager receiver has been called. A magnetic loudspeaker is usually used as the loudspeaker 101, and has a high inductance element 201. For instance, the inductances of loudspeakers used in pager receivers or the like are around 1 mH.

Suppose now that the oscillation frequency of the oscillator circuit 103 is $f_1$, and the frequencies resulting from a division by the variable frequency divider 108 are $f_2$, $f_3$ and $f_4$ (where $f_2 > f_3 > f_4$). Further suppose that the division numbers are $N_2$, $N_3$ and $N_4$. The following relationship will hold between these frequencies $f_1$, $f_2$, $f_3$ and $f_4$:

$$f_1 = N_2 f_2 = N_3 f_3 = N_4 f_4$$

FIGS. 7A to 7C are charts schematically showing signals having frequencies $f_3$ and $f_4$ and an output signal of the variable frequency divider 108. The frequency $f_3$ represented by FIG. 7A is an audible frequency of a few kHz, and the frequency $f_4$ represented by FIG. 7B is a frequency of several Hz. The waveform shown in FIG. 7C is an output signal of the variable frequency divider 108 combining these two frequencies, $f_3$ and $f_4$.

When the signal represented by FIG. 7C is emitted by the loudspeaker 101 of FIG. 6, it will constitute intermittent beep sounds. Since the inductance element 201 of the loudspeaker 101 develops a counter-electromotive force, the LED 102 will emit light at the same time.

Next will be described the characteristic operation of the present invention. When the external switch 109 is manipulated, the division in frequency divider 108 varies from $N_3$ to $N_2$, and the frequency changes from $f_3$ into $f_2$, which is outside the operational frequency range of the loudspeaker 101. Or else, if the frequency $f_2$ is outside the range of sound which is audible to the human, the output of the loudspeaker 101 will not be recognized as a sound. The output of the variable frequency divider 108, whose frequency has shifted from $f_3$ to $f_2$, as shown in FIG. 7C, is supplied to the inductance element 201 and to the LED 102 by way of the amplifier 105. As mentioned above, since the frequency $f_2$ is outside the operational frequency range of the loudspeaker 101, either the loudspeaker cannot be activated or its output cannot be heard, but only the LED 102 will intermittently light.

FIG. 8 is a more detailed diagram of the embodiment of the invention shown in FIG. 6 An oscillation output B of the oscilator circuit 103 is led to a frequency divider circuit 111 in the variable frequency divider 108. The output of this frequency divider circuit 111 is applied to another frequency divider circuit 112 and to one of the input terminals of an AND gate 113. The output of the frequency divider circuit 112 is applied to still another frequency divider circuit 114 and to one of the input terminals of an AND gate 115.

To the other input terminal of the AND gate 115 is connected a switch 116, which is controlled by the external switch 109. To the input terminal is also connected a resistor 117 whose other end is connected to the positive electrode terminal of a battery.

The external switch 109 and the resistor 117 are also connected to the other input terminal of the AND gate 113 by way of an inverter circuit 118. The outputs of these AND gates 113 and 115 are supplied to the input terminals of an OR gate 119.

The signal divided by the frequency divider circuit 114 is led to one of the input terminals of an OR circuit 120, having another input terminal which is grounded. The outputs of the OR gates 120 and 119 are both supplied to the input terminals of an AND gate 121. The output of the AND gate 121 is led to one of the input terminals of an AND gate 122, the other input terminal of which receives the alert signal A. The output of the AND gate 122 is connected to the base of a transistor 124 through a resistor 123. To the collector of the transistor 124 is connected the loudspeaker 101 and the LED 102.

The characteristic operation of the present invention in such a circuitry will be described in further detail below. Now suppose that the frequency $f_1$ of the output signal, represented by B, of the oscillator circuit 103 is 40 kHz. The frequency $f_1$ is divided at a rate of ½ by the frequency divider circuit 111 into the frequency $f_2=20$ kHz. One of the output signals of the frequency divider circuit 111 is supplied to the frequency divider circuit 112, wherein it is divided into 1/10 of the frequency $f_2$ to give the frequency $f_3=2$ kHz. This frequency $f_3$ is supplied to the AND gate 115. Another output signal of the frequency divider circuit 111 is supplied to the AND gate 113.

If, now, the switch 116 is open, the AND gate 115 will be made conductive by positive voltage applied via the resistor 117 connected to the positive terminal of the battery. The AND gate 113, to which a negative voltage is applied by way of the inverter circuit 118, will be non-conductive. As a result, the signal of $f_3=2$ kHz will be fed to the AND gate 119.

Meanwhile, an output signal from the frequency divider circuit 112 is supplied not only to the AND gate 115 but also to the frequency divider circuit 114. The signal of $f_3=2$ kHz is supplied to the frequency divider circuit 114, which divides the input signal to it by 2000. The resulting frequency-divided signal is the frequency $f_4=1$ Hz, which is supplied through the OR circuit 120 to the AND gate 121. This OR gate 120 is provided either to pass the output signal of the frequency divider circuit 114 or, irrespective of the signal from the frequency divider circuit 114, to give an output signal to the AND gate 121. Thus, if the grounded terminal of the OR gate 120 is connected to the power source side, there will always be a positive voltage on the output side.

These output signalsdof the OR gates 119 and 120 are respectively represented by FIGS. 7A and 7B. The output signal of the AND gate 121 is represented by FIG. 7C. If, in this state, the alert signal A is positive, the output signal of the AND gate 121 will be supplied to the transistor 124, by way of the AND circuit 122 and the resistor 123, for limiting the current. The transistor 124 amplifies the output of the AND gate 121, and supplies it to the loudspeaker 101 and the LED 102 to sound and light them, respectively.

Next, when the switch 116 is closed, the AND gate 115 in non-conductive and the AND gate 113 is conductive. Under these conditions, the OR gate 119 gives as its output a signal of $f_2=2$ kHz to the AND gate 121, whose output is represented by FIG. 7C. Thus, the frequency of the signal fed from gate 119 to gate 121 changes from $f_3$ to the frequency $f_2$, which is outside the operational frequency range of the loudspeaker. If, in this state, the alert signal A from outside is positive, the signal of $f_2=20$ kHz will be fed through the AND gate 122, resistor 123 and transistor 124 to the inductance element 201 of the loudspeaker 101. The counter-electromotive force of the inductance element 201 will turn on the LED 102, but the loudspeaker 101 will not sound because $f_2$ (20 kHz) is a frequency outside its operational range. Even if the loudspeaker does emit some sound, $f_2$ is outside the range of frequencies which are audible to the human ear, and therefore, it will not be heard. In this manner, the present invention makes it possible to select between the modes of sound and light and of light alone for the paging operation according to the ratios of the division by the frequency divider circuits (111, 112 and 114).

Since the signal synthesized and supplied by the AND gate 121 is intermittent at $f_4=1$ Hz, as illustrated in FIG. 7C, a high frequency component may be generated at the leading and trailing points of the signal of $f_4$ (i.e., the envelope of the interrupted frequency instead of the frequency, per se) and be audible from the loudspeaker 101. To solve this problem of response to the envelope, if the output frequency of OR gate 119 is $f_2$, it will be sufficient to add a circuit for stopping the intermittent sounding by $f_4$.

An example of this circuitry is illustrated in FIG. 9. It is characterized by the connection of the resistor 117 to one of the input terminals of the OR circuit 120, by way of an inverter circuit 125. If the switch 116 is closed so that alerting can be done only by the lighting of the LED, the output of the OR circuit 120 will be positive, irrespective of the signal from the frequency divider circuit 114. This continuous positive voltage can stop the intermittent operation by the frequency of $f_4$.

In addition, although the foregoing description is concerned with only pager receivers, in detail, it has to be noted that the circuitry according to the present invention can also be applied to wrist watches or the like, having both an indicator lamp and an emitting alarm sound, such as time signals.

As hitherto described, the present invention provides for the additional of a variable frequency divider circuit, for permitting a variation of the number of the division by external manipulation. It is, accordingly, possible to supply the alerting loudspeaker and LED with signals of a suitable frequency which can be varied as required to alert the bearer by both sound and light or by light alone. Moreover, in a pager receiver or the like, logic circuits are composed of integrated parts such as ICs or LSIs. The sounding circuit is formed as a part of a logic circuit consisting of an IC or an LSI. Therefore, the logic circuits, which are needed to realize a variable frequency divider circuit, according to the invention, in an IC or an LSI are nothing more than AND gates, inverter circuits, OR gates, resistors and a terminal for connecting a switch. These components do not cause the chip size of the IC or the LSI to be enlarged, but altogether they constitute a far smaller volume than the volume required by an additional inductance element.

What is claimed is:

1. A portable electronic apparatus comprising:

oscillator means for generating an oscillation signal;

audible annunciator means having an inductance element for generating an audible annunciating signal in response to a first actuation signal of a first frequency;

light emitting means which are turned on and off by counter-electromotive forces developed in said inductance element in response to one of said first actuation and a second actuation signal having a second frequency;

frequency divider means coupled to said audible annunciator means and to said light emitting means for frequency-dividing said oscillation signal to provide said first and second actuation signals and for selectively generating one of these actuation signals in response to a control signal;

gate means connected to said frequency divider means, said audible annunciator means and said light emitting means, for supplying said audible annunciator means and said light emitting means with one of said first and second actuation signals in response to an alert signal; and external switching means for supplying said first control signal to said frequency divider means.

2. The portable electronic apparatus as claimed in claim 1, said apparatus further comprising: radio receiver circuit means for receiving and demodulating a calling signal of a radio frequency to provide a baseband calling signal; and decoder means connected to the output of said radio receiver circuit means for comparing said baseband calling signal with a predetermined number and, if they are found identical during said comparison, for generating said alert signal and supplying it to said gate means.

3. The portable electronic apparatus as claimed in claim 1 or 2, wherein said frequency divider means comprises:

a first frequency divider for frequency-dividing said oscillation signal by a first ratio to provide a first frequency-divided signal having said second frequency;

a second frequency divider for frequency-dividing said first frequency-divided signal by a second ratio to provide a second frequency-divided signal having said first frequency;

a third frequency divider for frequency-dividing said second frequency-divided signal by a third ratio to provide a gating signal;

a first gate circuit for selectively passing one of said first and second frequency-divided signals in response to said control signal; and a second gate circuit for gating the output of said first gate circuit by said gating signal and thereby to generate, as the output of said frequency divider means, one of said first and second actuation signals.

4. The portable electronic apparatus as claimed in claim 3, wherein said frequency divider means further comprises means responsive to said control signal and is connected between the output of said third frequency divider and said second gate circuit for inhibiting said gating signal from reaching said second gate circuit and for supplying it to said second gate circuit with a continuous gating signal in order to hold said second gate circuit in a conductive condition.

5. A paging apparatus comprising: annunciator means having an inductor and giving an audible paging call responsive to a first actuation signal having a frequency which is within a predetermined frequency band, said inductor being coupled to develop counter-electromotive forces in response to a second actuation signal having said first frequency and a second frequency which is outside said predetermined frequency band but which is below a given frequency; inducator means for giving a visible paging call in response to said counter-electromotive force; first frequency dividing means responsive to an incoming signal having said given frequency for dividing said given frequency into either said first or said second frequency; and means for selecting between said first and second actuation signals, said selection causing said annunciator means to give said audible paging call when said first actuation signal is selected and to cause only said indicator means to give said visible paging call when said second actuation signal is selected.

6. The apparatus of claim 5 and frequency dividing means driven by at least one of said first and second actuation signals for interrupting said first actuation signal whereby said audible paging call is given intermittently.

7. The apparatus of claim 5 or claim 6 and a pair of gate means, each of said gate means being coupled into an individually associated path for transmitting a corresponding one of said first and second actuation signals, and said selecting means comprising means for selectively enabling either one of said gates while simultaneously inhibiting the other of said gates.

8. The apparatus of claim 7 wherein said first annunciator means is a loud speaker and said inductor is a voice coil of said speaker, said predetermined frequency band being a band within which human beings can recognize the output of said speaker as a sound.

9. A method of giving audible and visible alarm comprising the steps of:

(a) detecting an alert signal to provide an alert detection signal;

(b) generating a first signal having a relatively low frequency which is within a human beings range of hearing and a second signal having relatively high frequency which is higher than said human beings range of hearing;

(c) selecting one of said first and second signals;

(d) responding to said alert detection signal by applying the selected signal to a parallel circuit of a light and a loud speaker having a voice coil, said loud speaker sounding in response to this applied first signal to give said audible alarm and said voice coil generating a counter-electromotive force in response to one of the applied first and second signals; and (e) applying said counter-electromotive force to said light to give said visible alarm.

* * * * *